US005354029A

United States Patent [19]

Ziaylek, Jr. et al.

[11] Patent Number: 5,354,029

[45] Date of Patent: Oct. 11, 1994

[54] QUICK RELEASE TANK SUPPORT BRACKET WITH POSITIVE LOCKING ENGAGEMENT MEANS

[76] Inventors: Theodore Ziaylek, Jr., 140 Riverview Dr.; Michael P. Ziaylek, 3 Brook La., both of Yardley, Pa. 19067

[21] Appl. No.: 30,963

[22] Filed: Mar. 12, 1993

[51] Int. Cl.[5] ..... A47C 7/62; A62C 39/00; A47F 5/00

[52] U.S. Cl. ..... 248/313; 169/51; 211/75; 224/148; 248/316.5; 297/191

[58] Field of Search ..... 248/311.2, 313, 316.1, 248/316.5; 297/191; 169/51; 224/148; 211/75

[56] References Cited

U.S. PATENT DOCUMENTS

| | | | |
|---|---|---|---|
| 2,109,821 | 3/1938 | Dunica . | |
| 2,151,387 | 3/1939 | Leatherbury | 248/316.5 X |
| 3,204,775 | 9/1965 | Smith . | |
| 3,547,391 | 12/1970 | Johnson . | |
| 3,603,550 | 9/1971 | Byrd . | |
| 3,780,972 | 12/1973 | Brodersen . | |
| 3,823,907 | 7/1974 | Ziaylek, Jr. . | |
| 3,921,950 | 11/1975 | Sentinella . | |
| 3,971,591 | 7/1976 | Ziaylek . | |
| 4,013,255 | 3/1977 | Sentinella . | |
| 4,304,383 | 12/1981 | Huston . | |
| 4,586,687 | 5/1986 | Ziaylek, Jr. . | |
| 4,821,990 | 4/1989 | Porter et al. . | |
| 5,100,007 | 3/1992 | Espasandin . | |
| 5,213,392 | 5/1993 | Bostrom et al. | 297/191 X |
| 5,275,462 | 1/1994 | Pond et al. | 297/191 |

*Primary Examiner*—Ramon O. Ramirez
*Assistant Examiner*—Derek J. Berger
*Attorney, Agent, or Firm*—Sperry, Zoda & Kane

[57] ABSTRACT

The present invention comprises a quick release tank support bracket having a positive locking engagement along with an optional operative seat back supportive assembly which includes support bars mounted with a frame with clamp arms secured to the support bars. At least two such support bars are included with at least one or more clamp arms secured thereto. The clamp arms are movable between a closed position for retaining of a tank therein and an opened position for releasing of the tank therefrom. Each of the support bars includes a crank arm which is interconnected by an inner engagement device for controlling cooperative relative movement of the two clamp arms with respect to one another. Closure lugs are positioned integral with the clamping arms and extend inwardly and include tank engaging surfaces such that when the tank is inserted into place by pushing horizontally toward the backing plate, the clamping arms and the support rods will automatically move to the tank retaining position. Also simultaneously the seat back members which are secured to the clamping bars will move together to form a rear seat cushion area for a conventional seat as may be used on emergency vehicles such as fire trucks and the like.

20 Claims, 3 Drawing Sheets

QUICK RELEASE TANK SUPPORT BRACKET WITH POSITIVE LOCKING ENGAGEMENT MEANS

BACKGROUND OF THE INVENTION

1. Field Of The Invention

The present invention deals with the field of devices for supporting or holding tanks or other similar devices such as air tanks or cylinders which are often carried upon the back of a firefighter or rescue squad member.

These types of devices are normally worn by a firefighter or by other emergency vehicle personnel while seated in the emergency vehicle enroute to the location of the current emergency. The present device provides a means for providing a seat back for the comfort of the rescue worker while simultaneously allowing the tank having emergency oxygen or other devices therein maintained within the seat in such a manner as to be capable of being strapped to the firefighter while allowing the firefighter to resume a comfortable position leaning backward against a seat back cushion.

More particularly the present invention deals with air tank cylinders adapted to be carried upon one's back normally as a part of a breathing apparatus. These designs when molded within a seat construction as in the present invention permit swift and easy release of the cylinder such that the wearer or other emergency personnel can walk away with the cylinder strapped to his back as a part of the breathing apparatus immediate upon reaching the location of the emergency while still maintaining comfort of a conventional seat back while in the vehicle enroute to the emergency location.

2. Description Of The Prior Art

Different devices have been patented covering various seat back designs and tank holders such as U.S. Pat. No. 50,597 patented Oct. 24, 1865 to Joshua W. Jones on a "Book-Clamp"; and U.S. Pat. No. 645,391 patented Mar. 13, 1900 to L. E. Gower on a "Fruit Jar Holder"; and U.S. Pat. No. 1,984,207 patented Dec. 11, 1934 to A. Ceslowitz on a "Combination Article Of Furniture"; and U.S. Pat. No. 2,109,821 patented Mar. 1, 1938 to R. W. Dunica on a "Fire Extinguisher Holder"; and U.S. Design Pat. No. Des. 181,275 patented Oct. 29, 1957 to C. Cooper on an "Ejection Seat"; and U.S. Pat. No. 2,929,587 patented Mar. 22, 1960 to J. Martin on "Ejection Seats For Aircraft"; and U.S. Pat. No. 3,194,529 patented Jul. 13, 1965 to G. R. Brock on a "Bracket For Holding Fire Extinguishers"; and U.S. Pat. No. 3,204,775 patented Sep. 7, 1965 to G. L. Smith et al on a "Support For Self-Contained Breathing Apparatus"; and U.S. Pat. No. 3,490,727 patented Jan. 20, 1970 to H. Q. Miller on a "Holding Apparatus For Loads Adapted To Be Strapped To The Back Of Humans"; and U.S. Pat. No. 3,521,768 patented Jul. 28, 1970 to H. Rohwedder on a "Support For A Grain Tank Discharge Pipe"; and U.S. Pat. No. 3,547,391 patented Dec. 15, 1970 to D. Johnson on a "Quick Release Support For Rescue Breathing Apparatus"; and U.S. Pat. No. 3,603,550 patented Sep. 7, 1971 to C. Byrd on a "Quick Release Support"; and U.S. Design Pat. No. Des. 222,527 patented Nov. 2, 1971 to T. Ziaylek, Jr. on a "Bracket For Use With Lifesaving Equipment"; and U.S. Pat. No. 3,737,133 patented Jun. 5, 1973 to A. Boecker on a "Quick-Release Article Holder"; and U.S. Pat. No. 3,780,972 patented Dec. 25, 1973 to J. Brodersen on a "Mounting Apparatus For Gas Containers"; and U.S. Pat. No. 3,823,907 patented Jul. 16, 1974 to T. Ziaylek, Jr. on a "Positive Locking Device"; and U.S. Pat. No. 3,921,950 patented Nov. 25, 1975 to V. Sentinella on "Extinguisher Mountings"; and U.S. Pat. No. 3,971,591 patented Jul. 27, 1976 to J. Ziaylek on a "Quicseat"; and U.S. Pat. No. 4,304,383 patented Dec. 8, 1981 to P. Huston on a "Bracket For Holding A Tank"; and U.S. Pat. No. 4,586,687 patented May 6, 1986 to Theodore Ziaylek, Jr. on an "Air Tank Support Of The Quick Release Type"; and U.S. Design Pat. No. Des. 286,824 patented Nov. 25, 1986 to P. Opsvik on a "Rocking Chair"; and U.S. Design Pat. No. Des. 298,704 patented Nov. 29, 1988 to Theodore Ziaylek, Jr. on a "Seat For Use Primarily In Emergency Vehicles"; and French Patent No. 380.320 issued Jul. 29, 1907.

SUMMARY OF THE INVENTION

The present invention provides a quick release tank support bracket with positive locking engagement means and operative supportive seat back assembly including a frame preferably having a backing plate which is securable to any environmental structure such as immediately adjacent the rear portion of a seat cushion within an emergency vehicle. A first support bar preferably comprising a hexagonally shaped cylindrical rod member is pivotally mounted within the frame means and extends vertically therealong. A first clamp arm is adjustably secured to the first support bar in order to be pivotally movable therewith. This first clamp arm extends outwardly from the first support bar and defines a first tank engaging surface thereon. The first tank arm and the first support bar are pivotally movable between a tank retaining position and a tank releasing position.

A first crank arm is adjustably secured to the first support bar to be pivotable therewith. The first crank arm extends outwardly from the first support bar to define a first distal end thereof. A first seat back bracket is secured to the first clamp arm means and extends outwardly therefrom. A first seat back is adjustably secured to the first seat bracket in order to provide a seat back rest responsive to the clamp arm being in the tank retaining position. This first seat back preferably includes a first seat back cushion thereon.

A first closure lug is included being preferably integral with the first clamp arm and adjustably attached to the first support bar in order to be movable therewith and extending outwardly therefrom toward the second support bar. The first closure lug includes a first tank abutment surface thereon preferably which is adapted to be contacted by a tank during movement thereof into engagement with the tank support bracket to facilitate urging of the first support bar and the first clamp arm to the tank retaining position.

A second support bar which preferably is configured as an hexagonal cylindrical rod member is pivotally mounted within the frame and extends vertically therein preferably extending in a direction parallel with respect to the first support bar. A second clamp arm is also included adjustably secured to the second support bar to be pivotally movable therewith. This second clamp arm extends outwardly from the second support bar and defines a second tank engaging surface thereon. The second clamp arm and the second support bar are pivotable between a tank retaining position and a tank releasing position.

A second seat back bracket is preferably secured to a second clamp arm in such a manner as to extend outwardly therefrom. A second seat back is preferably adjustably secured to the second seat back bracket in such a manner as to provide an arcuate seat back rest contour along with the first seat back means responsive to the second clamp arm being in the tank retaining position. This second seat back means preferably will also include a second seat back cushion.

In the preferred configuration a second closure lug will be preferably integrally configured with the second clamp arm and adjustably secured to the second support bar in such a manner as to be movable therewith. Said second closure lug extends outwardly therefrom toward the first support means. The second closure lug also including a second tank abutment surface thereon adapted to be contacted by a tank during movement thereof into engagement with the tank support bracket to facilitate urging of the second support bar and the second clamp arm means to the tank retaining position.

Furthermore, the present invention includes an inter-engagement means connecting the first distal end of the first crank arm and the second distal end of the second crank arm in such a manner as to facilitate cooperative movement between the first clamp arm attached to the first support bar and the second clamp arm attached to the second support bar. This cooperative movement between the two support bars will be maintained at all times as the device is moved between the tank releasing position and the tank retaining position. In the preferred configuration the second support bar will be adapted to pivot simultaneously in the opposite direction of pivot of the first support bar thereby facilitating the opening and closing of the two clamping means with respect to a tank positioned therebetween.

It is an object of the present invention to provide a quick release tank support bracket with positive locking engagement means and operatively supporting seat back assembly wherein the number of moving parts is minimized.

It is an object of the present invention to provide a quick release tank support bracket with positive locking engagement means and operatively supporting seat back assembly wherein initial capital outlay for equipment is minimized.

It is an object of the present invention to provide a quick release tank support bracket with positive locking engagement means and operatively supporting seat back assembly wherein down time due to required maintenance is minimized.

It is an object of the present invention to provide a quick release tank support bracket with positive locking engagement means and operatively supporting seat back assembly wherein maintenance requirements are minimized overall.

It is an object of the present invention to provide a quick release tank support bracket with positive locking engagement means and operatively supporting seat back assembly wherein a tank can be easily retained within a seat back configuration in an emergency vehicle.

It is an object of the present invention to provide a quick release tank support bracket with positive locking engagement means and operatively supporting seat back assembly wherein a tank can be quickly and easily replaced into engagement with respect to a tank holding bracket.

It is an object of the present invention to provide a quick release tank support bracket with positive locking engagement means and operatively supporting seat back assembly wherein a tank can be quickly released during emergency conditions often encountered by emergency vehicles.

It is an object of the present invention to provide a quick release tank support bracket with positive locking engagement means and operatively supporting seat back assembly wherein a soft rear seat back cushion is provided between the wearer of an air tank and the air tank itself while traveling seated within an emergency vehicle.

It is an object of the present invention to provide a quick release tank support bracket with positive locking engagement means and operatively supporting seat back assembly wherein movement of the clamping arms between the tank releasing and tank retaining position can be operated otherwise manually.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
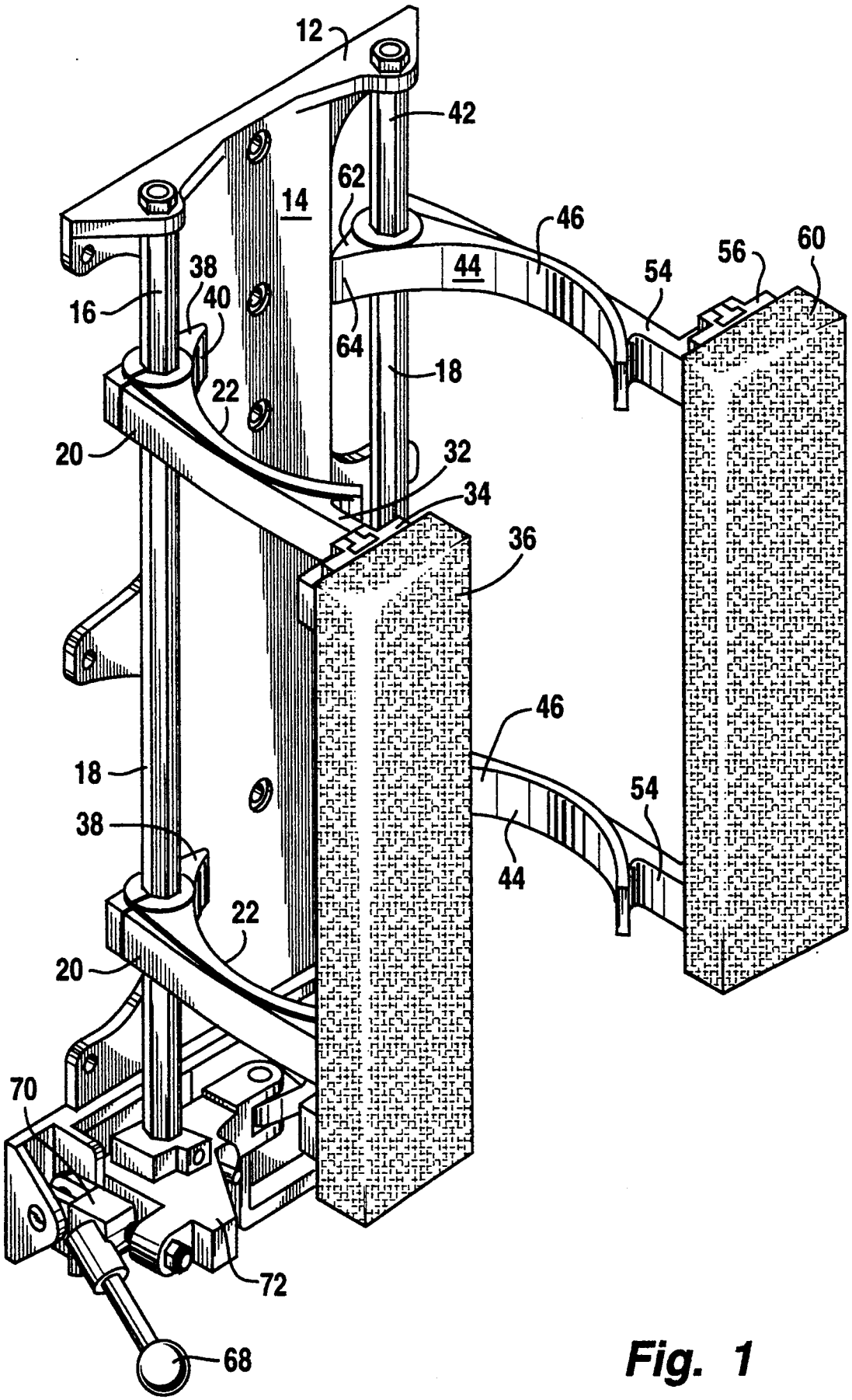
FIG. 1 is a front perspective illustration of an embodiment of the quick release tank support bracket of the present invention.
Figure 2:
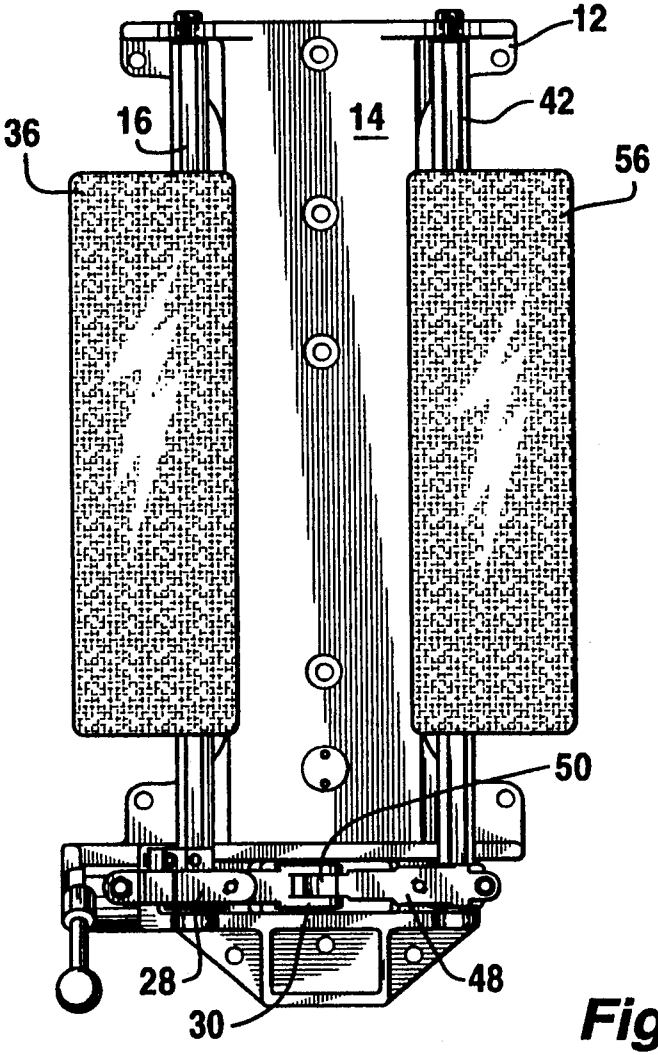
FIG. 2 is a front plan view of the embodiment shown in FIG. 1.
Figure 3:
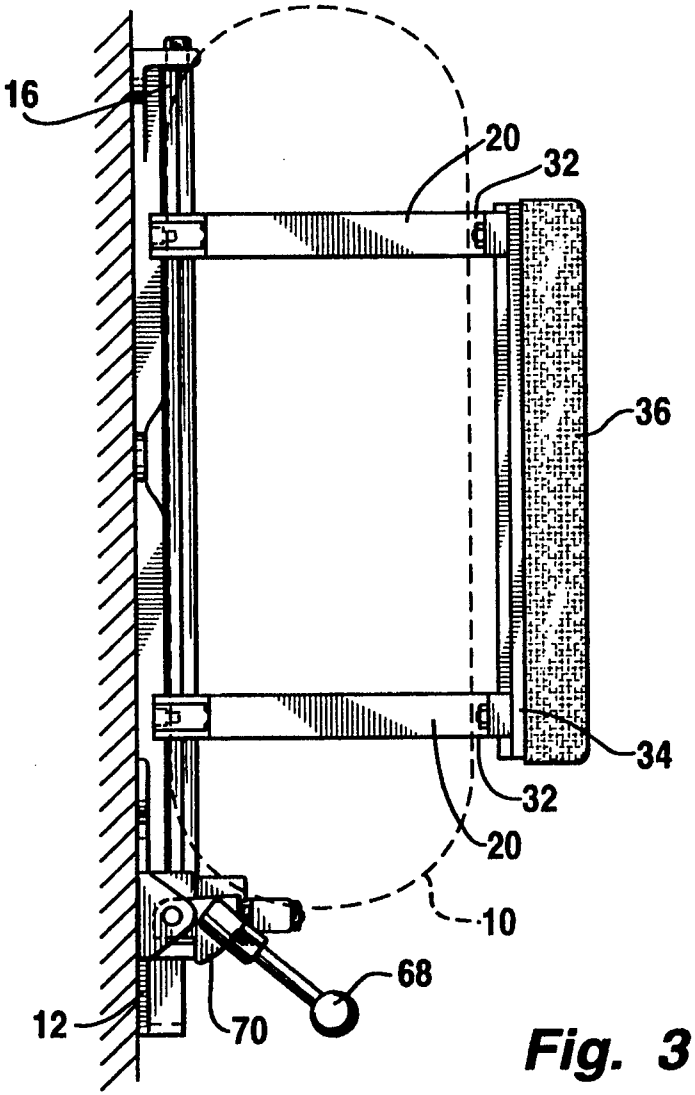
FIG. 3 is a side plan view of the embodiment shown in FIG. 1.

The present invention provides a quick release tank support bracket with a positive locking engagement means and an optional operative supportive seat back assembly which is designed to selectively release or retain a tank 10 with respect to a recessed position within the seat back portion of a seat normally found in an emergency vehicle. A prior art design is shown in U.S. Pat. No. 4,586,687 which patent is hereby incorporated by reference into the present specification. The present design provides a distinct improvement over this design as will be discussed herebelow. The tank 10 is adapted to be secured with respect to a frame 12 which may include a backing plate 14. Backing plate 14 is preferably adapted to be secured to any vertically extending structure such as a wall area within an emergency vehicle housing or vehicle. The bracket of the present invention further includes a first support bar means 16 extending generally vertically and being movably mounted within the frame 12. The first support bar means 16 will preferably take the configuration of a hexagonal rod member 18 to facilitate keying thereon. In a similar manner the frame 12 will be designed to receive a second support bar means 42 which preferably also comprises a hexagonal rod member 18 mounted therewithin and being capable of pivotal movement with respect to the frame 12. Preferably the first support bar 16 and the second support bar 42 will both be extending in an approximate vertical direction and will be parallel with respect to one another.

A first clamp arm means 20 is adapted to be secured to the hexagonal rod member 18 firmly therearound such as to be keyed to the first support bar 16. As such, pivotal movement of the first support bar 16 will cause similar pivotal movement of the first clamp arm 20. The first clamp arm 20 and the first support bar 16 are designed to be moved between a tank retaining position 24 adapted to hold a tank 10 with respect to the frame 12 and tank releasing position 26 adapted to release the tank 10 from engagement with respect to the frame 12.

For this purpose the first clamp arm means 20 will include a first tank engaging surface 22 which preferably is arcuate.

In a similar configuration the second support bar 42 will include a second clamp arm means 44 secured thereto and keyed thereto in order to be movable pivotally along with the second support bar 42 between the tank retaining position 24 and the tank releasing position 26. Second clamp arm means 44 will also include a second tank engaging surface 46 adapted to abut and engage a tank 10 as desired.

Cooperative rotation of the first support bar 16 and the second support bar 42 is achieved through the crank arm configuration. A first crank arm 28 is adapted to be secured with respect to the first support bar 16 and in a similar manner a second crank bar 48 is adapted to be secured with respect to the second support bar 42. An interengagement means 52 such as a pin member in cooperation with slots defined in the crank arm is adapted to engage the first distal end 30 of first crank arm 28 and the second distal end 50 of second crank arm means 48 in such a manner as to control relative rotation between the first support bar 16 and the second support bar 42. In the preferred configuration clockwise pivoting of the first support bar 16 will result in a similar angular movement of counterclockwise movement by the second support bar 42.

The support bracket of the present invention further includes a first closure lug means 38 secured with respect to the first support bar 16 and extending outwardly therefrom preferably toward the second support bar 42. Preferably the first closure lug means 38 will be integrally formed with respect to the first clamp arm means 20. The first closure lug means 38 will also include a first tank abutment surface 40 adapted to be engaged by a tank 10 as it is moved in the direction toward the backing plate 14 of frame 12.

Figure 5:
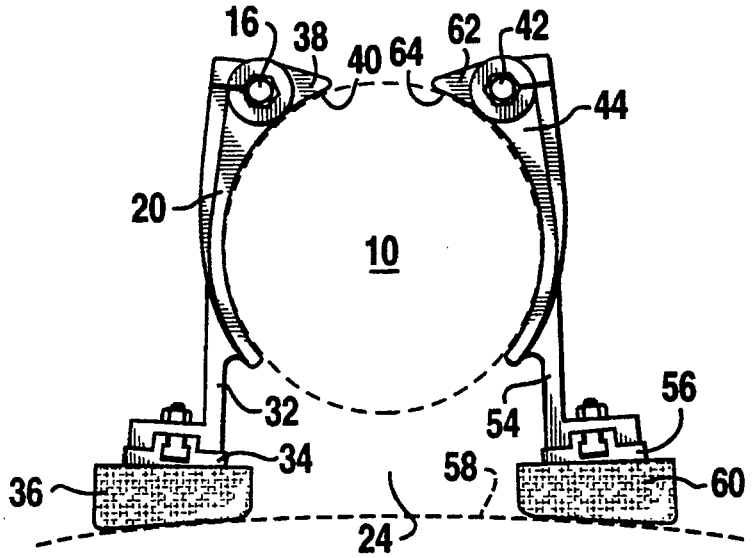
FIG. 5 is a top plan view of the clamping arm and seat back configuration shown in the tank retaining position.

In a similar manner the second closure lug means 62 will be preferably adjustably secured with respect to the second support bar 42 such as to be rotatable therewith. The second closure lug means 62 will preferably include a second tank abutment surface 64 thereon. This surface will be adapted to abut a tank 10 as it is moved inwardly toward the backing plate 14. As the tank 10 first contacts the second abutment surface 64 and the first tank abutment surface 40 it will cause these members to move in the direction shown by arrows 66 in FIG. 6. This will cause the first clamp arm 20, shown to the left in FIG. 6, to rotate in a counterclockwise direction and will cause the second clamp arm means 44, as shown to the right in FIG. 6, to rotate in a clockwise direction thereby moving of both clamp arms as well as the support bars 16 and 42 to the tank retaining position 24. This final position is shown in the configuration in FIG. 5. If sufficient force is provided to the movement of the tank to this position, this is all the force needed in order to lock the tank in place within the tank retaining position 24. As such, this provides a positive locking engagement achievable solely by a user leaning backwardly as they sit in the chair or by separate force applied by a hand to cause the tank 10 to move into the engaged position as shown in FIG. 5. This movement is made possible solely by the inclusion of the first closure lugs 38 and second closure lugs 62.

Preferably the present invention includes a first seat back bracket means 32 adapted to be secured with respect to the first clamp arm 20 to extend outwardly from the distal end thereof. This first seat back bracket will preferably include a first seat back member 34 at the outermost portion thereof which may include a first seat back cushion 36 to comprise a conventional cushion which can be rested against by the back of a user of the apparatus of the present invention.

Figure 4:
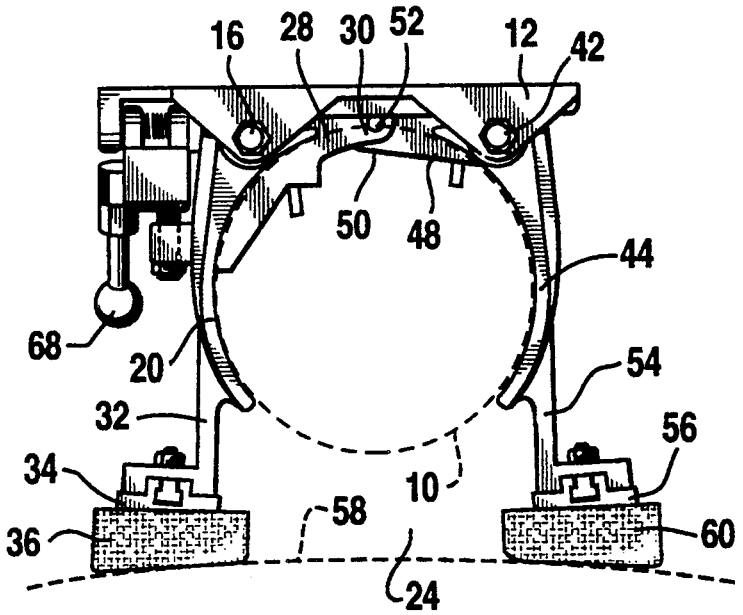
FIG. 4 is a bottom plan view of the embodiment shown in FIG. 1.

In a similar manner a second seat back means 54 may be positioned extending outwardly from the second crank arm 48 and can include a second seat back means 56 thereon to achieve a back rest. Also a second seat back cushion means 60 may be included secured to the second seat back 56 to provide a more comfortable seat back cushion. With this overall configuration of the second seat back cushion 60 and the first seat back cushion 36 there will be the definition of an arcuate backrest contour 58 as shown best in FIGS. 4 and 5.

By providing such a seat back cushion which itself is securable to the two clamping arms the present invention provides a means for automatically providing of a seat back cushion while automatically removing the seat back cushion out of the way whenever the tank is being removed. The present invention further discloses a manual means for operating of the apparatus of the present invention including a handle 68. The handle 68 includes a cam member 70 secured thereto. Movement of the handle 68 will cause rotation of the cam 70 and will cause movement of the cam follower 72. Rotational movement of cam follower 72 will allow rotational movement of both the first support bar 16 and the second support bar 42 as desired. Thus manual operation of the present invention by the operation of handle 68 as shown in detail in U.S. Pat. No. 4,586,687, which has been incorporated by reference, is supplemented by the additional movement means capable by the additional apparatus disclosed in the present invention. In particular the first closure lugs 38 and second closure lugs 62 provide a novel and distinct means for achieving fast and efficient closing of the tank support bracket for movement thereof to the tank retaining position 24. While at the same time the movement of the clamping arms achieved by this movement will automatically move the first and second seat back means 34 and 56 into position for supporting the back of the user while the tank is retained.

Figure 6:
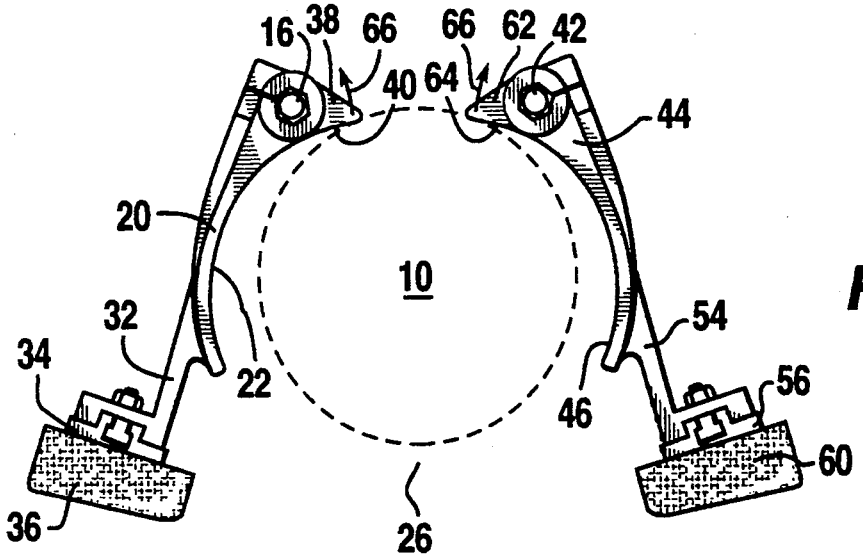
FIG. 6 is an illustration of the elements shown in FIG. 5 shown in the tank releasing position.

To further facilitate operation of the present invention it should be appreciated that the first clamp arm 20 and the second clamp arm 44 can be adjustably positioned vertically along either of the hexagonal support bar rod members. In a similar manner the seat back cushions 36 and 60 are preferably vertically movable with respect to the hexagonal rod members. In this manner full adjustability of positioning of the retaining clamp arms as well as the seat back members is achievable. Furthermore adjustable vertical positioning of the closure lugs 38 and with respect to the hexagonal support bars is also desired to facilitate accurate positioning for direction of force along lines 66 as shown in FIG. 6.

while particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A quick release tank support bracket with positive locking engagement means and operative supportive seat back assembly comprising:

A. a frame means,

B. a first support bar means pivotally mounted within said frame means and extending vertically therealong;

C. a first clamp arm means attached to said first support bar means to be pivotally movably therewith, said first clamp arm means extending outwardly from said first support bar means and defining a first tank engaging surface means thereon, said first clamp arm means and said first support bar means being pivotable between a tank retaining position and a tank releasing position;

D. a first crank arm means secured to said first support bar means to be pivotable therewith, said first crank arm means extending outwardly from said first support bar means to define a first distal end means thereof;

E. a first closure lug means attached to said first support bar means and extending outwardly therefrom to be moveable therewith, said first closure lug means including a first tank abutment surface thereon adapted to be contacted by a tank during movement thereof into engagement with the tank support bracket to facilitate urging of said first support bar means and said first clamp arm means to the tank retaining position;

F. a second support bar means pivotally mounted within said frame means and extending vertically therealong;

G. a second clamp arm means attached to said second support bar means to be pivotally movably therewith, said second clamp arm means extending outwardly from said second support bar means and defining a second tank engaging surface means thereon, said second clamp arm means and said second support bar means being pivotable between a tank retaining position and a tank releasing position;

H. a second crank arm means secured to said second support bar means to be pivotable therewith, said second crank arm means extending outwardly from said second support bar means to define a second distal end means thereof;

I. a second closure lug means attached to said second support bar means and extending outwardly therefrom to be moveable therewith, said second closure lug means including a second tank abutment surface thereon adapted to be contacted by a tank during movement thereof into engagement with the tank support bracket to facilitate urging of said second support bar means and said second clamp arm means to the tank retaining position;

J. interengagement means connecting said first distal end means of said first clamp arm means and said second distal end means of said second clamp arm means to facilitate cooperative movement of said first clamp arm means attached to said first support bar means and said second clamp arm means attached to said second support bar means between the tank releasing position and the tank retaining position simultaneously;

K. a first seat back means fixedly secured with respect to said first clamp arm means and being moveable therewith between a tank retaining position and a tank releasing position and adapted to provide a seat back rest responsive to said first clamp arm means being in the tank retaining position; and L. a second seat back means fixedly secured with respect to said second clamp arm means and being moveable therewith between a tank retaining position and a tank releasing position and adapted to provide a seat back rest responsive adapted to provide a seat back rest responsive to said second clamp arm means being in the tank retaining position.

2. A quick release tank support bracket with positive locking engagement means and operative supportive seat back assembly as defined in claim 1 wherein said first seat back means and said second seat back means define an arcuate contoured seat back.

3. A quick release tank support bracket with positive locking engagement means and operative supportive seat back assembly as defined in claim 1 wherein said first seat back means includes a first seat back cushion secured thereto.

4. A quick release tank support bracket with positive locking engagement means and operative supportive seat back assembly as defined in claim 1 wherein said second seat back means includes a second seat back cushion secured thereto.

5. A quick release tank support bracket with positive locking engagement means and operative supportive seat back assembly as defined in claim 1 wherein said first closure lug means and said first clamp arms mean are integrally formed.

6. A quick release tank support bracket with positive locking engagement means and operative supportive seat back assembly as defined in claim 1 wherein said second closure lug means and said second clamp arm means are integrally formed.

7. A quick release tank support bracket with positive locking engagement means and operative supportive seat back assembly as defined in claim 1 wherein said first clamp arm means is adjustably positionable with respect to said first support bar means.

8. A quick release tank support bracket with positive locking engagement means and operative supportive seat back assembly as defined in claim 1 wherein said second clamp arm means is adjustably positionable with respect to said second support bar means.

9. A quick release tank support bracket with positive locking engagement means and operative supportive seat back assembly as defined in claim 1 wherein said first closure lug means is adjustably positionable with respect to said first support bar means.

10. A quick release tank support bracket with positive locking engagement means and operative supportive seat back assembly as defined in claim 1 wherein said second closure lug means is adjustably positionable with respect to said second support bar means.

11. A quick release tank support bracket with positive locking engagement means and operative supportive seat back assembly as defined in claim 1 wherein said first closure lug means extends outwardly from said first support bar means toward said second closure lug means.

12. A quick release tank support bracket with positive locking engagement means and operative supportive seat back assembly as defined in claim 1 wherein said second closure lug means extends outwardly from said second support bar means toward said first closure lug means.

13. A quick release tank support bracket with positive locking engagement means and operative supportive seat back assembly as defined in claim 1 wherein said interengagement means is operable to pivot said first support bar means and said second support bar means in opposite directions when moving between the tank retaining position and the tank releasing position.

14. A quick release tank support bracket with positive locking engagement means and operative supportive seat back assembly as defined in claim 1 wherein said first support bar means and said second support bar means are positioned parallel with respect to one another.

15. A quick release tank support bracket with positive locking engagement means and operative supportive seat back assembly as defined in claim 1 wherein said frame means includes a backing plate.

16. A quick release tank support bracket with positive locking engagement means and operative supportive seat back assembly as defined in claim 1 wherein said first support bar means and said second support bar means each comprise hexagonal shaped cylindrical rod members.

17. A quick release tank support bracket with positive locking engagement means and operative supportive seat back assembly as defined in claim 1 further including:

A. a first seat back bracket means fixedly secured to said first clamp arm means and extending outwardly therefrom, said first seat back means being directly secured to said first seat back bracket means; and B. a second seat back bracket means fixedly secured to said second clamp arm means and extending outwardly therefrom, said second seat back means being directly secured to said first seat back bracket means.

18. A quick release tank support bracket with positive locking engagement means and operative supportive seat back assembly as defined in claim 17 wherein said first seat back means is adjustably securable to said first seat back bracket means to facilitate modification of positioning of said first seat back means as desired.

19. A quick release tank support bracket with positive locking engagement means and operative supportive seat back assembly as defined in claim 17 wherein said second seat back means is adjustably securable to said second seat back bracket means to facilitate modification of positioning of said second seat back means as desired.

20. A quick release tank support bracket with positive locking engagement means and operative supportive seat back assembly comprising:

A. a frame means including a backing plate being securable to selective environmental structure;

B. a first support bar means comprising a hexagonal shaped cylindrical rod member pivotally mounted within said frame means and extending vertically therealong;

C. a first clamp arm means adjustable secured to said first support bar means to be pivotally movably therewith, said first clamp arm means extending outwardly from said first support bar means and defining a first tank engaging surface means thereon, said first clamp arm means and said first support bar means being pivotable between a tank retaining position and a tank releasing position;

D. a first crank arm means adjustably secured to said first support bar means to be pivotable therewith, said first crank arm means extending outwardly from said first support bar means to define a first distal end means thereof;

E. a first seat back bracket means secured to said first clamp arm means and extending outwardly therefrom;

F. a first seat back means adjustably secured to said first seat back bracket means to provide a seat back rest responsive to said first clamp arm means being in the tank retaining position, said first seat back means including a first seat back cushion means;

G. a first closure lug means integral with said first clamp arm means and adjustably attached to said first support bar means to be moveable therewith and extending outwardly therefrom toward said second support bar means, said first closure lug means including a first tank abutment surface thereon adapted to be contacted by a tank during movement thereof into engagement with the tank support bracket to facilitate urging of said first support bar means and said first clamp arm means to the tank retaining position;

H. a second support bar means comprising a hexagonal shaped cylindrical rod member pivotally mounted within said frame means and extending vertically therealong in parallel with respect to said first support bar means;

I. a second clamp arm means adjustably secured to said second support bar means to be pivotally movably therewith, said second clamp arm means extending outwardly from said second support bar means and defining a second tank engaging surface means thereon, said second clamp arm means and said second support bar means being pivotable between a tank retaining position and a tank releasing position;

J. a second crank arm means adjustably secured to said second support bar means to be pivotable therewith, said second crank arm means extending outwardly from said second support bar means to define a second distal end means thereof;

K. a second seat back bracket means secured to said second clamp arm means and extending outwardly therefrom;

L. a second seat back means adjustably secured to said second seat back bracket means to provide an arcuate seat back rest contour along with said first seat back means responsive to said second clamp arm means being in the tank retaining position, said second seat back means including a second seat back cushion;

M. a second closure lug means integral with said second clamp arm means and adjustably secured to said second support bar means to be moveable therewith and extending outwardly therefrom toward said first support bar means, said second closure lug means including a second tank abutment surface thereon adapted to be contacted by a tank during movement thereof into engagement with the tank support bracket to facilitate urging of said second support bar means and said second clamp arm means to the tank retaining position; and N. interengagement means connecting said first distal end means of said first clamp arm means and said second distal end means of said second clamp arm means to facilitate cooperative movement of said first clamp arm means attached to said first support bar means and said second clamp arm means attached to said second support bar means between the tank releasing position and the tank retaining position simultaneously, said second support bar means being adapted to pivot simultaneously in the opposite direction of pivot of said first support bar means.

* * * * *